US008286713B2

(12) United States Patent
Broussard

(10) Patent No.: US 8,286,713 B2
(45) Date of Patent: Oct. 16, 2012

(54) OIL AND GAS WELL COMPLETION SYSTEM AND METHOD OF INSTALLATION

(75) Inventor: Earl Broussard, Houston, TX (US)

(73) Assignee: Argus Subsea, Inc., Houston, TX (US)

( * ) Notice: Subject to any disclaimer, the term of this patent is extended or adjusted under 35 U.S.C. 154(b) by 538 days.

(21) Appl. No.: 12/387,407

(22) Filed: May 1, 2009

(65) Prior Publication Data

US 2009/0211761 A1 Aug. 27, 2009

Related U.S. Application Data

(63) Continuation-in-part of application No. 12/049,093, filed on Mar. 14, 2008, now Pat. No. 7,604,047, which is a continuation of application No. 11/216,227, filed on Aug. 31, 2005, now Pat. No. 7,419,001.

(60) Provisional application No. 60/682,250, filed on May 18, 2005, provisional application No. 61/126,302, filed on May 2, 2008.

(51) Int. Cl.
*E21B 34/04* (2006.01)

(52) U.S. Cl. ..... 166/341; 166/338; 166/344; 166/368

(58) Field of Classification Search ..... 166/343, 166/338, 339, 341, 344, 348, 368, 378–382; 439/194, 191

See application file for complete search history.

(56) References Cited

U.S. PATENT DOCUMENTS 2,948,338 A 8/1960 Raulins et al.
3,158,420 A 12/1963 Olson et al.
3,318,384 A 5/1967 Brown
3,478,298 A 11/1969 Nelson
3,509,296 A 4/1970 Harshman et al.
3,531,236 A 9/1970 Braddick et al.

(Continued)

FOREIGN PATENT DOCUMENTS

GB 2397312 A 7/2004

(Continued)

OTHER PUBLICATIONS

European Search Report of related application No. 05257653.5, Aug. 2006, 7 pages.

*Primary Examiner* — Matthew Buck
(74) *Attorney, Agent, or Firm* — Gary L. Bush; Douglas W. Rommelmann; Andrews Kurth LLP

(57) ABSTRACT

A completion system and method for completing a subsea well with angular alignment-free assembly The system includes a series of circumferential channels formed in a well completion device at a boundary between a tubing hanger and the completion device. The circumferential channels provide complete circular fluid paths with respect to the tubing hanger and the completion device. A supply bore and a drain bore are in communication with each circumferential channel and oriented to supply a fluid to and remove fluid from, respectively, the circumferential channel. A circumferential electrical connector couples the tubing hanger and the completion device. The circumferential channels and bores provide fluid services between the completion device and the tubing hanger and the electrical connector provides electrical services to the tubing hanger. The completion system allows the fluid and electrical services to be provided without requiring any angular alignment between the tubing hanger and the completion device.

27 Claims, 16 Drawing Sheets

U.S. PATENT DOCUMENTS 3,963,133 A 6/1976 Gilli
3,990,510 A 11/1976 Decuir
4,022,281 A 5/1977 Pennock
4,067,385 A 1/1978 Schwager et al.
4,077,472 A 3/1978 Gano
4,146,093 A 3/1979 Horvath et al.
4,154,298 A 5/1979 Gano
4,188,050 A 2/1980 Lochte
4,296,806 A 10/1981 Taylor et al.
4,300,637 A 11/1981 Valka
4,333,531 A 6/1982 Lawson
4,474,236 A 10/1984 Kellett
4,496,162 A 1/1985 McEver et al.
RE31,933 E 7/1985 Taylor et al.
4,544,036 A 10/1985 Saliger
4,607,691 A * 8/1986 Bridges ..... 166/88.4
4,635,728 A 1/1987 Harrington
4,721,163 A 1/1988 Davis
4,740,657 A 4/1988 Tsukagoshi et al.
4,770,248 A 9/1988 Houlgrave et al.
4,791,986 A 12/1988 Vallet
4,797,029 A 1/1989 Cowan
4,797,117 A 1/1989 Ayers
4,817,716 A 4/1989 Taylor et al.
4,823,879 A 4/1989 Brammer
4,832,125 A 5/1989 Taylor
4,836,288 A 6/1989 Wester
4,943,243 A 7/1990 Appleton
5,046,557 A 9/1991 Manderscheid
5,052,941 A * 10/1991 Hernandez-Marti et al. . 439/194
5,120,268 A 6/1992 Gerrans
5,145,006 A 9/1992 June
5,409,403 A 4/1995 Falossi et al.
5,411,099 A 5/1995 Braddick
5,462,119 A 10/1995 de Souza et al.
5,501,281 A 3/1996 White et al.
5,544,707 A 8/1996 Hopper et al.
5,685,373 A 11/1997 Collins
5,743,333 A 4/1998 Willauer et al.
5,794,323 A * 8/1998 Galle ..... 29/464
5,823,802 A 10/1998 Bartley
5,875,852 A 3/1999 Floyd et al.
5,904,207 A 5/1999 Rubbo et al.
5,944,102 A 8/1999 Kilgore et al.
5,975,210 A 11/1999 Wilkins
5,988,276 A 11/1999 Oneal
6,009,951 A 1/2000 Coronado et al.
6,062,872 A 5/2000 Strange et al.
6,082,460 A * 7/2000 June ..... 166/348
6,109,352 A 8/2000 Edwards et al.
6,112,811 A 9/2000 Kilgore et al.
6,138,751 A 10/2000 Hart
6,186,227 B1 2/2001 Vaynshteyn et al.
6,227,301 B1 5/2001 Edwards et al.
6,349,772 B2 2/2002 Mullen et al.
6,360,822 B1 * 3/2002 Robertson ..... 166/368
6,386,292 B1 5/2002 Bland
6,394,837 B1 * 5/2002 Edwards et al. ..... 439/426
6,408,949 B1 6/2002 Aquilera
6,470,968 B1 10/2002 Turner
6,530,574 B1 3/2003 Bailey et al.
6,554,062 B1 4/2003 Dewey et al.
6,557,629 B2 * 5/2003 Wong et al. ..... 166/76.1
6,575,764 B1 6/2003 Reipur
6,609,567 B2 8/2003 Ingram et al.
6,640,902 B2 11/2003 Baten et al.
6,681,861 B2 * 1/2004 Davidson et al. ..... 166/382
6,719,063 B2 4/2004 Adams et al.
6,758,272 B2 7/2004 Bixenman et al.
6,763,891 B2 * 7/2004 Humphrey et al. ..... 166/368
6,769,491 B2 8/2004 Zimmerman et al.
6,790,057 B2 9/2004 DelPrete et al.
6,808,022 B2 10/2004 Smith
6,808,024 B2 10/2004 Schwendemann et al.
6,854,521 B2 2/2005 Echols et al.
6,902,005 B2 6/2005 Radi et al.
6,929,493 B2 * 8/2005 Hall et al. ..... 439/191
7,032,673 B2 4/2006 Dezen
7,063,160 B2 * 6/2006 Fenton et al. ..... 166/369
7,083,452 B2 * 8/2006 Eriksson et al. ..... 439/194
7,128,143 B2 * 10/2006 Van Bilderbeek ..... 166/96.1
7,222,674 B2 5/2007 Reynolds
7,318,479 B2 1/2008 Williams
7,355,122 B2 * 4/2008 Moore ..... 174/84 R
7,419,001 B2 * 9/2008 Broussard ..... 166/77.51
7,604,047 B2 * 10/2009 Broussard ..... 166/75.14
7,610,956 B2 * 11/2009 Farquharson et al. ..... 166/86.1
7,762,338 B2 * 7/2010 Fenton et al. ..... 166/348
7,770,650 B2 * 8/2010 Young et al. ..... 166/344
2003/0116328 A1 6/2003 Doane et al.
2003/0155126 A1 8/2003 Radi et al.
2005/0006107 A1 1/2005 Nguyen et al.
2006/0260799 A1 11/2006 Broussard
2009/0260832 A1 * 10/2009 Fenton et al. ..... 166/368

FOREIGN PATENT DOCUMENTS

GB 2408992 A 6/2005
GB 2440940 A 2/2008
WO 2004083598 A1 9/2004
WO 2008113979 A1 9/2008

* cited by examiner 60
60a
62
62
42
16a
16
20a
20
24
42a
12
F
54
48
46
Z
R 84
80
82
86
86
88
81
92
94a
90
94
94b
90a
16a
42b
42
16
20a
20
24
42a
12
F
54
48
46
Z
R

OIL AND GAS WELL COMPLETION SYSTEM AND METHOD OF INSTALLATION

CROSS-REFERENCE TO RELATED APPLICATIONS

This application is a continuation-in-part of pending U.S. patent application Ser. No. 12/049,093, filed Mar. 14, 2008, now U.S. Pat. No. 7,604,047 entitled "Universal Tubing Hanger Suspension Assembly and Well Completion System and Method of Using Same," which is a continuation of U.S. patent application Ser. No. 11/216,277, filed Aug. 31, 2005, entitled "Universal Tubing Hanger Suspension Assembly and Well Completion System and Method of Using Same," now U.S. Pat. No. 7,419,001, which claims priority to U.S. Provisional Application Ser. No. 60/682,250 filed May 18, 2005, all of which applications are hereby incorporated by reference in their entirety. This application also claims the benefit of U.S. Provisional Application Ser. No. 61/126,302 entitled "Oil and Gas Well Completion System and Method for Installation," filed on May 2, 2008, and which is incorporated by reference in its entirety.

BACKGROUND

1. Field of the Invention

The field of the inventions as recited in the claims attached hereto is a subsea oil and gas well, and more particularly a system that allows angular alignment-free assembly of well components when completing the oil and gas well.

2. Discussion of Prior Art

A typical subsea oil or gas well includes a wellhead installed at the sea floor. The wellhead supports many components that are used to first drill the well and then remove oil or gas through the well. For example, a drilling blowout preventer (BOP) stack is installed on the wellhead, and a well bore is drilled while successively installing concentric casing strings in the well bore. Typically, each successive casing string is cemented at its lower end and includes a casing hanger sealed with a mechanical seal assembly at its upper end in the wellhead.

To produce a cased well, a production tubing string and tubing hanger are run into the well bore through the BOP stack and the tubing hanger is landed, sealed and locked in the wellhead. Then the BOP stack is removed and a Christmas tree is lowered onto the wellhead. A Christmas tree is an oilfield term for an assembly, installed at the top of the wellhead, that contains control valves and chokes to allow control of the flow of oil and gas from the subsea well. To ensure proper operation and safety of the well, connections are remotely formed between the Christmas tree, the wellhead, and the tubing hanger.

In a completed well system, the Christmas tree is connected to the top of the wellhead over the tubing hanger. The tubing hanger supports at least one production tubing string which extends into the well bore. The tubing hanger includes a production bore that communicates with the tubing string. The tubing hanger supports an annulus conduit that communicates with the annulus which surrounds the outside of the tubing string that is inside the innermost or production casing string. In addition, the tubing hanger includes at least one vertical annulus bore for communicating fluid between the annulus conduit and a corresponding annulus bore in the Christmas tree. The tubing hanger may additionally include one or more service and control conduits for communicating control fluids and well chemicals though the tubing hanger or electrical power to devices or positions located in or below the tubing hanger.

The tubing hanger normally is sealed and rigidly locked into the wellhead housing or component in which it is landed. The tubing hanger typically includes an integral locking mechanism which, when activated, secures the tubing hanger to the wellhead housing or a profile in the casing hanger. The locking mechanism ensures that any subsequent pressure from within the well acting on the tubing hanger will not cause the tubing hanger to lift from the wellhead.

Current oil and gas well completion systems require angular orientation of the tubing hanger with the wellhead and with the BOP stack and Christmas tree. In some completion systems, hydraulically remotely actuated pins or rods in the BOP stack are extended into the well bore to orient the tubing hanger or running tool during the completion process. This is done to orientate the tubing hanger to allow vertical stabs for the electrical connector to spatially line up in the vertical and horizontal planes so as to accomplish the tubing hanger interface. This arrangement requires very precise alignment tolerance due to the tolerance stack up variance in the vertical and horizontal planes as well as the machine tolerances in the equipment. Such alignment tolerance requires BOP stack modifications and "as build jigs" fabricated prior to running the tubing hanger and Christmas tree.

Furthermore, special tools for the tubing hanger are required prior to deployment. These tools and jigs must be maintained for well workover and abandonment of the well in order to properly align the associated BOP stack for subsequent employment. In a tubing spool or horizontal tree configuration, angular orientation is accomplished with a sleeve as part of the tubing spool or horizontal tree body. In the tubing spool this allows a vertical stab via a pin, because orientation is accomplished by a fixed orientation bushing. In the horizontal tree, electrical connection is accomplished via a mechanically or hydraulically actuated pin extended through the spool body into the tubing hanger where the electrical female part of the connection resides. Orientation again is accomplished due to the fixed orientation sleeve.

In some completion systems, orientation is accomplished using a bushing set by the drill string in the wellhead and oriented via a slot in the BOP wellhead connector. This arrangement requires that the BOP connector be oriented prior to running the BOP stack on the wellhead. The electrical connector is still made up with an oriented vertical stab.

The costs associated with such completion systems which require angular orientation are high. Such costs are described here.

The engineering work to set up and implement an orientation system into a BOP is significant. It requires two engineers at a cost of $200 per/hr. totaling about $16,000 and two man days of work.

The cost to modify a BOP stack for orientation during the drilling process requires temporary abandonment of the well. Such cost could be as high as $600,000 per day. For a five-day period, the total cost could be $3,000,000.

The cost of additional tool rentals to orientate tubing hangers is about $20,000.

For a horizontal completion, in order to orientate the functions of production bore, annulus bore, hydraulic feed through coupled with a concentric electrical connector, a helix on the tubing hanger sleeve is used to interface with a pin in the horizontal tree spool body. This procedure also requires temporary abandonment of the well, because the procedure can not be employed during the drilling of the well, and because the casing hangers require a full bore to the wellhead housing. As described above, temporary abandonment of a well costs about $600,000 per/day.

3. Identification of Objects of the Invention

The inventions as embodied in the claims attached hereto have as an object, a system that allows completion of an oil or gas well without any requirement for angular alignment of well components.

Another object is to provide a method for angular alignment-free completion of an oil or gas well.

SUMMARY

A completion system, and a corresponding method, for completing a subsea well, where the well includes a wellhead and a tubing hanger disposed in the wellhead and supports a string of production tubing, allows for angular alignment-free assembly of the subsea well. The completion system includes a series of circumferential channels formed in a well completion device at a boundary between the tubing hanger and the well completion device. The circumferential channels provide complete circular fluid paths with respect to the tubing hanger and the well completion device. At least one supply bore is in communication with each circumferential channel and oriented to supply a fluid to the circumferential channel, and at least one drain bore is in communication with each circumferential channel and oriented to remove fluid from the circumferential channel. Finally a circumferential electrical connector couples the tubing hanger and the completion device. The circumferential channels and bores provide fluid services between the completion device and the tubing hanger and the electrical connector provides electrical services to the tubing hanger. The completion system allows the fluid and electrical services to be provided without requiring any angular alignment between the tubing hanger and the completion device.

DESCRIPTION OF THE DRAWINGS

The Detailed Description will refer to the following drawings, in which like numerals indicate like items, and in which.

DETAILED DESCRIPTION

Figure 1:
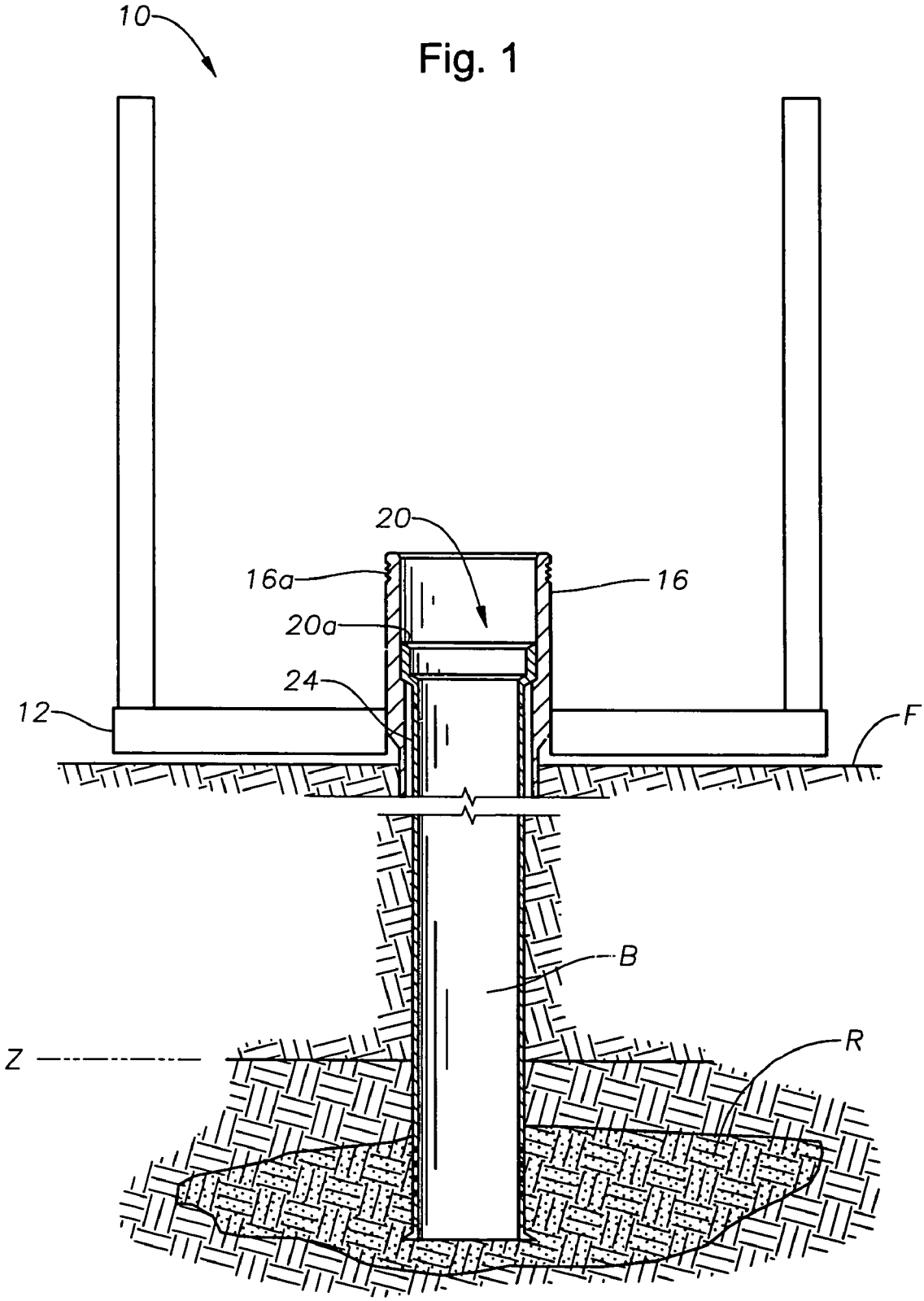
FIG. 1 illustrates a wellhead, with a casing string landed therein, of a subsea oil or gas well in a schematic, partial sectional elevation view.

Disclosed herein is an angular alignment-free system, mechanism, and method of installation for completion of a subsea oil or gas well in which any angular alignment of various service conduits and bores between the well components, including, for example, the wellhead, BOP, Christmas tree, and tubing hanger, is rendered unnecessary. FIG. 1 is a partial schematic sectional view of selected components of a subsea oil and gas well (hereafter, well) 10 that has been drilled and that has its bore hole lined with a casing. The well 10 includes a guide frame 12, which rests on seabed F, wellhead 16, casing hanger 20 and casing pipe 24. Well bore B extends from the sea floor F down to a zone Z, in which is a reservoir R of hydrocarbon fluids. The wellhead 16 is supported above the seabed F by the guide frame 12, which also serves to position various completion systems on the well 10, as will be described later. The well bore B has a series of concentric pipe strings, including the casing 24, extending from the sea floor F down into the bore B to the hydrocarbon reservoir R. Those skilled in the art will recognize that the well 10 shown in FIG. 1 merely is representative of a typical subsea well and that the inventions recited in the claims attached hereto are not limited to wells of this precise configuration. Additionally, the figures are not drawn to scale due to the tremendous depths to which wells are drilled, and many details of these wells, not necessary for understanding the claims, are not illustrated.

Still referring to FIG. 1, the wellhead 16 preferably is above the sea floor F and forms a high pressure housing. Preferably, the top of the wellhead 16 is about ten feet above the sea floor F. The wellhead 16 includes an external profile 16*a* for connection with a corresponding connector of a blowout preventer (BOP) stack and a Christmas tree, as will be described below. The casing hanger 20 and casing 24 are landed and secured in the wellhead 16. The wellhead 16 includes several internal profiles, dimensions, and details for landing, locking and sealing the casing hanger 20 and casing 24 inside the wellhead 16.

Figure 2:
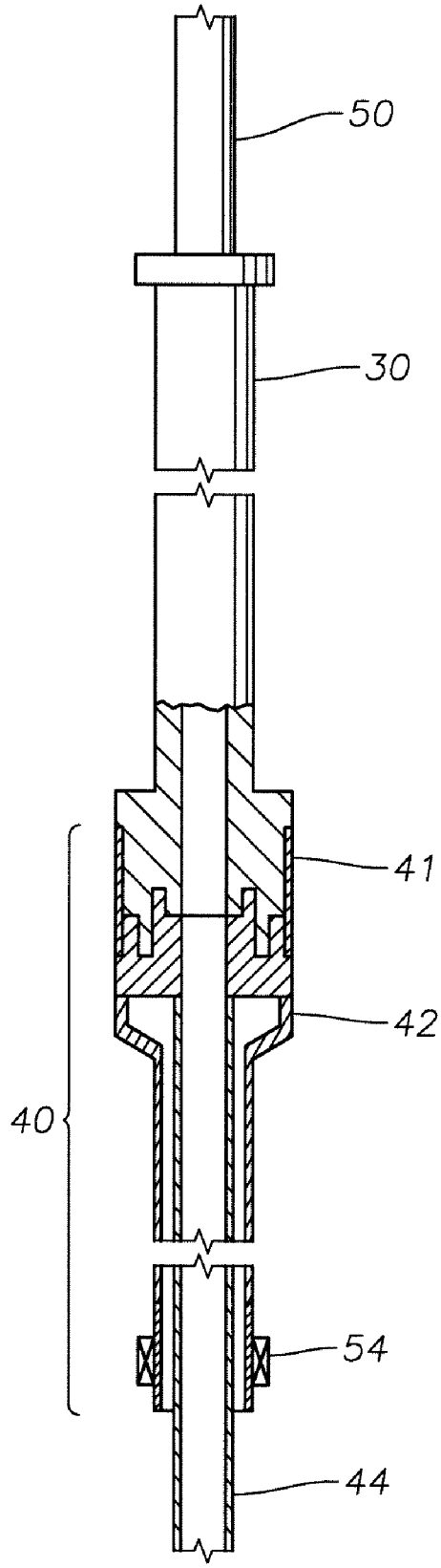
FIG. 2 illustrates an exemplary tubing hanger running tool attached to a tubing hanger and production tubing, in partial sectional view, for installation in the subsea well of FIG. 1.

Following the setting of the casing 24 as shown in FIG. 1, a tubing hanger assembly is typically run in the well 10 using a tubing hanger running tool. FIG. 2 illustrates an exemplary tubing hanger running tool 30 and attached tubing hanger assembly 40. Although not shown, the tubing hanger assembly 40 (for a tubing hanger that is in landed in the wellhead 16) includes a housing having a string of production tubing extending from the housing substantially down to the production zone Z. The tubing hanger assembly 40 includes tubing hanger 42 and packer system 46. Referring now to FIG. 1, when the tubing hanger assembly 40 is landed in the wellhead 16, the weight of the assembly 40, including the production tubing, is supported by one or more shoulders 20*a* formed in the wellhead 16. Although not shown in FIG. 1, the casing hanger 20 includes internal profiles, dimensions and details for landing, locking and sealing the tubing hanger 42 in the well 10. Certain of these features of the casing hanger 20 mate with the packer system 46 shown in FIG. 2.

Figure 3:
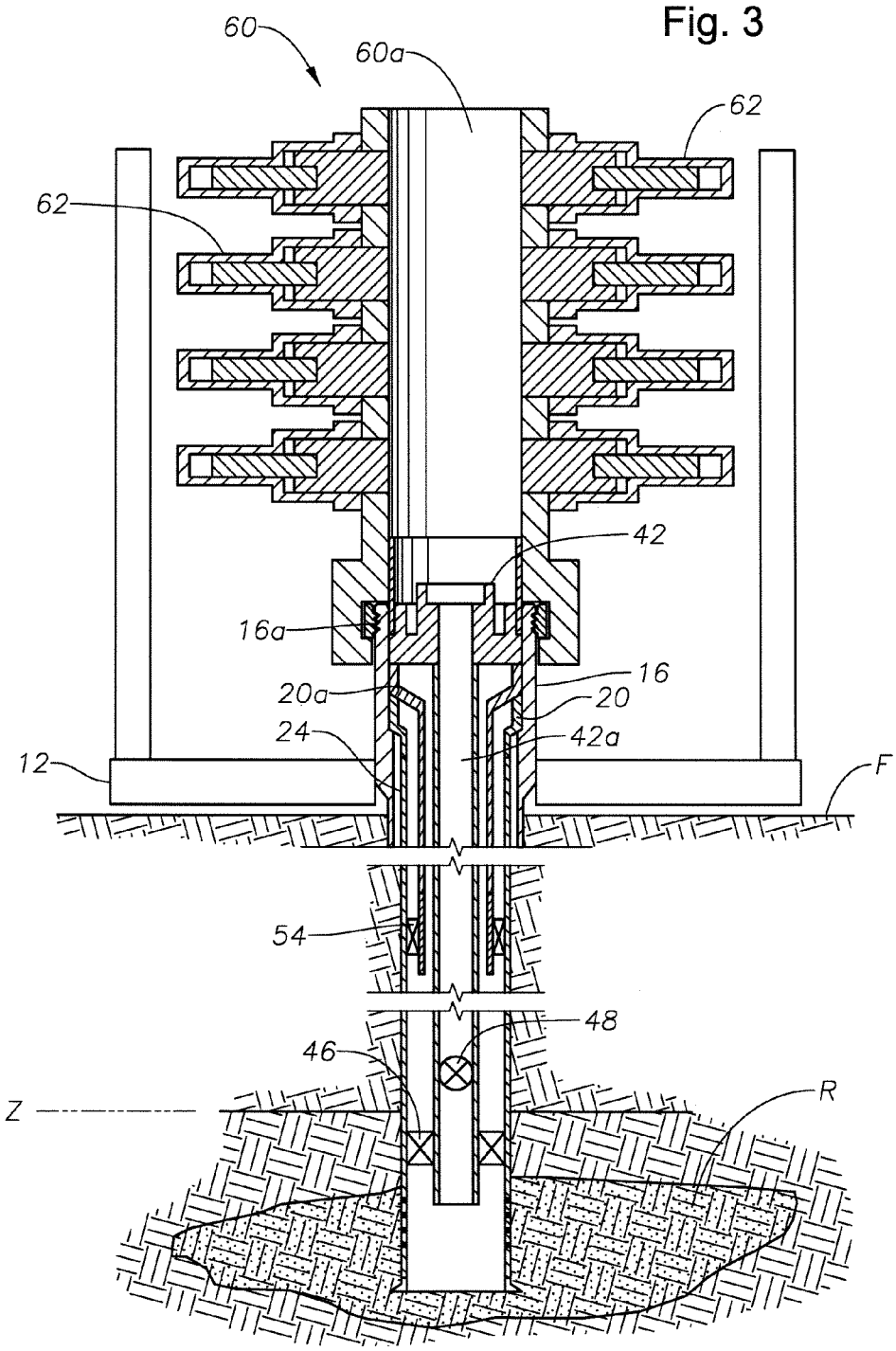
FIG. 3 illustrates the subsea oil and gas well of FIG. 1 with a blowout preventer (BOP) latched to a wellhead, with the tubing hanger and production tubing installed therein.

Referring to FIG. 3, the well 10 is shown with BOP stack 60 installed, tubing hanger assembly 40 landed, and tubing hanger running tool 30 (FIG. 2) removed. There are several types and configurations of BOP stacks that are suitable for use with the claimed inventions, and the claimed inventions are not limited to the particular BOP stack 60 shown in the figures. Bore 60*a* of the BOP stack 60 is shown with a diameter approximating the diameter of the wellhead 16. However, the BOP bore diameter need only have a diameter the same as or slightly greater than the diameter of any tool or well component that must pass through the BOP stack 60 for the desired installation or work over operation. A work over is an oilfield term that refers to a variety of remedial operations performed on a producing well with the purpose of restoring or increasing production.

Figure 4A:
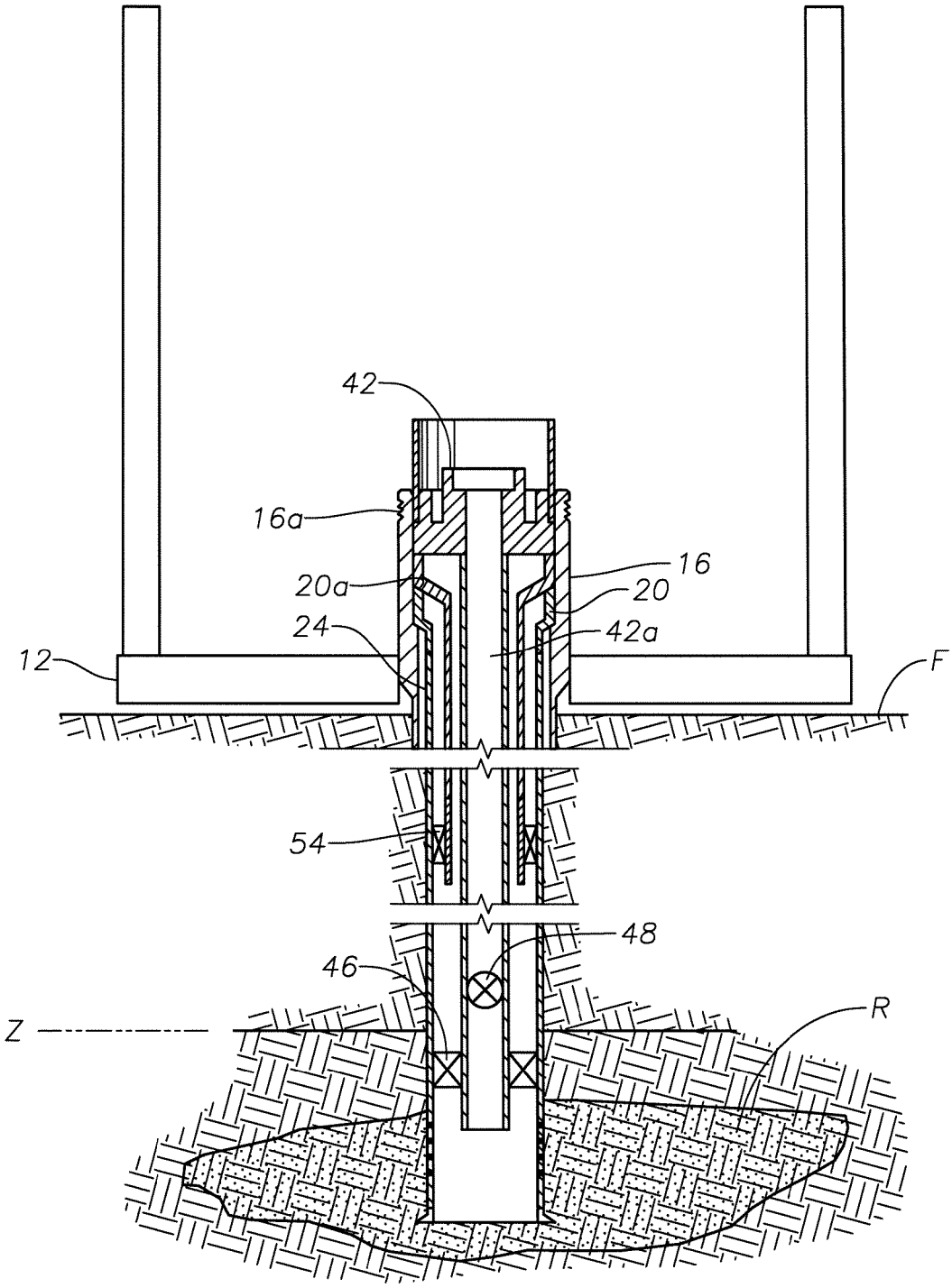
FIGS. 4A-4C illustrate the subsea well of FIG. 1 with the BOP removed and a tubing hanger installed.
Figure 4B:
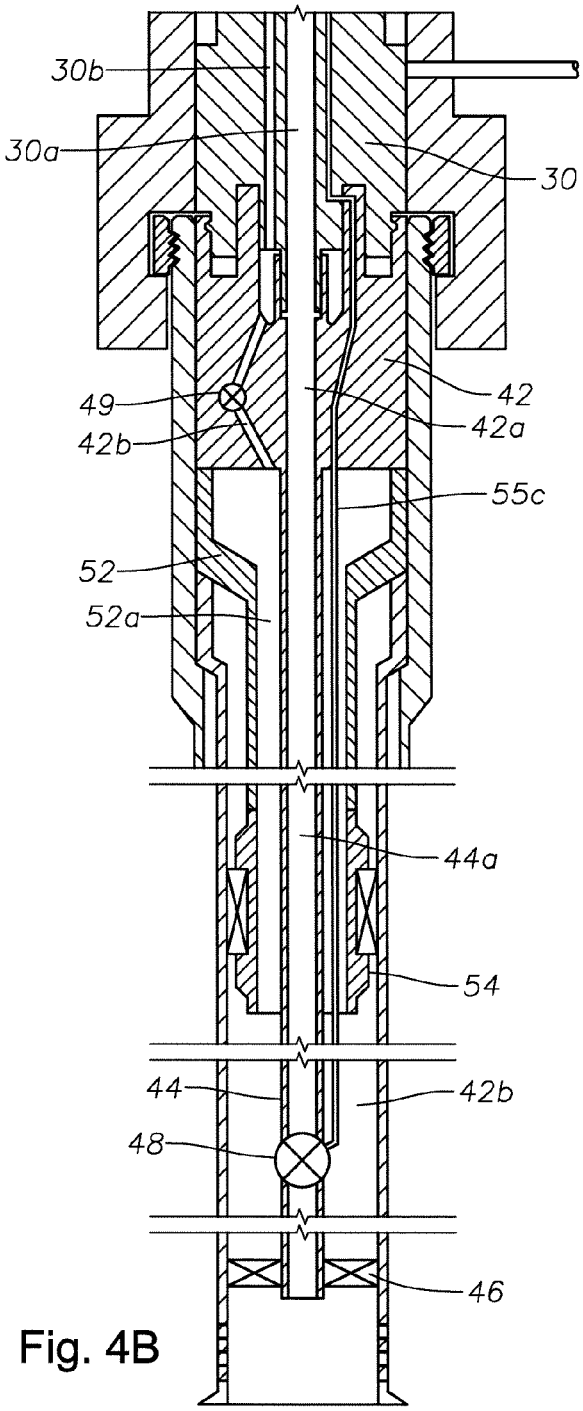

FIG. 4A illustrates the well 10 after landing, sealing, and locking the tubing hanger and production tubing in the well 10 and removal of the BOP stack 60. FIG. 4B illustrates additional details of the tubing hanger assembly 40, including a string of production tubing 44 connected to the tubing hanger 42. The production tubing 44 defines a production tubing bore 44*a* extending axially through the production tubing 44. The tubing hanger 42 includes a production bore 42*a* in fluid communication with the production tubing bore 44*a*. The production bore 42*a* extends substantially vertically through the tubing hanger 42. As previously discussed, the production tubing 44 typically extends down to the production zone Z. The production tubing 44 may include a SSSV 48 at a desired depth within the well bore.

The tubing hanger 42 also includes an annulus passageway 42*b* extending through the tubing hanger 42. In an embodiment, an annulus isolation valve 49 is included in the tubing hanger 42. The annulus isolation valve 49 is arranged and designed to seal and close off the annulus passageway 42*b*.

The tubing hanger 42 includes a tubing hanger lower assembly 52 at its lower end. The lower assembly 52 may be connected to or integral with the tubing hanger 42. The lower assembly 52 includes sealing and lockdown assembly 54. The lower assembly 52 is a tubular member having a throughbore and extends around the production tubing 44 with a production annulus 52*a* defined therebetween. While the production tubing 44 has a length such that its lower end extends to the production zone Z, the tubing hanger lower assembly 52 preferably has a length substantially less than the length of the production tubing 44.

Figure 4C:
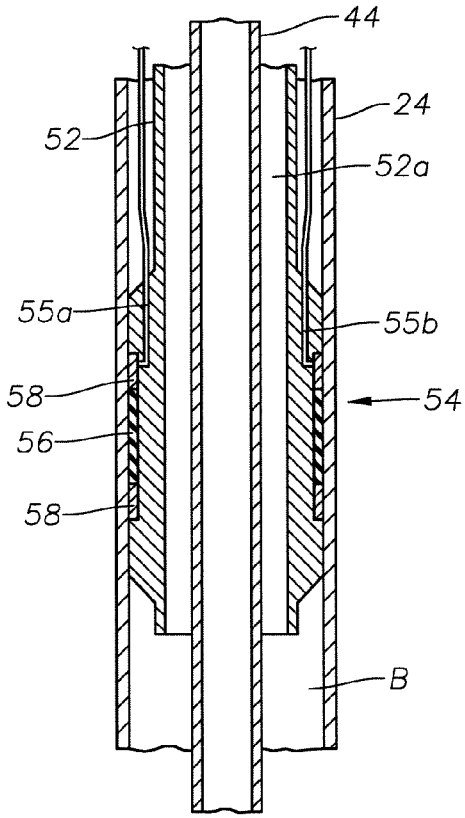

The sealing and lockdown assembly 54, shown in more detail in FIG. 4C, is carried by the tubing hanger lower member 52. The sealing/lockdown assembly 54 includes a sealing apparatus 56 and a movement prevention lockdown apparatus 58. In an embodiment, the sealing apparatus 56 and the lockdown apparatus 58 are contained within a unitary assembly. In another embodiment, the sealing apparatus 56 and the lockdown apparatus 58 are separate assemblies. The sealing apparatus 56 and lockdown apparatus 58 may positioned in the casing 24 above the SSSV 48.

In an embodiment, the lockdown apparatus 58 includes elements or slips, which may be metallic or non-metallic, adapted to engage the interior of the casing 24. When engaged, the lockdown apparatus 58 prevents vertical movement of the production tubing 44 relative to the casing 24.

The sealing apparatus 56 includes a sealing element, which may be made of elastomerics or other materials (including composites), or a metal seal, either of which are adapted to form an annular seal between the casing 24 and the production tubing 44.

The sealing apparatus 56 and the lockdown apparatus 58 may be independently activated or jointly activated. The activation and de-activation of the lockdown apparatus 58 and the sealing apparatus 56 is hydraulically controlled through ports provided in the tubing hanger assembly 40, as will be explained below. The activation and de-activation also may be electronically, mechanically, or electrically activated or de-activated.

As shown in FIG. 4B, in an embodiment, one or more hydraulic control lines 55 extend through the tubing hanger 42 to provide hydraulic control to devices below the tubing hanger 42. For example, hydraulic control lines 55*a* and 55*b* (FIG. 4C) may be used to activate and de-activate the sealing apparatus 56 and the lockdown apparatus 58, and hydraulic control line 55*c* (FIG. 4B) may be run to the SSSV 48. The hydraulic control lines 55*a* and 55*b* may be run in the production annulus 52*a* between the lower member 52 and the production tubing 44, as shown in FIG. 4B. The SSSV hydraulic control line 55*c* may be run in a production tubing annulus 52*a* between the production casing 24 and the production tubing 44.

Referring to FIGS. 2, 4B, and 4C, the tubing hanger assembly 40 is preferably lowered into the cased well bore B and wellhead 16 with tubing hanger running tool 30. The tubing hanger running tool 30 is adapted to lock into the upper end 41 of the tubing hanger 42. The tubing hanger running tool 30 includes a production bore 30*a*, which extends through the running tool 30 and communicates with the tubing hanger production bore 42*a*. The tubing hanger running tool 30 also includes an annulus access bore 30*b*, which communicates with the tubing hanger annulus passageway 42*b* and hydraulic lines communicating with the hydraulic lines 55 of the tubing hanger 42.

Referring to FIGS. 2 and 3, installation of the tubing hanger assembly 40 includes the lowering, through a riser (not shown) and BOP stack 60, of the production tubing 44, the sealing and lockdown assembly 54, the tubing hanger lower assembly 52, and the tubing hanger 42 with the tubing hanger running tool 30 and an installation tubing string 50. The BOP stack 60 includes rams 62 that are closed after the tubing hanger 42 and lower portion of the tubing hanger running tool 30 pass the rams 62 and are landed at a predetermined distance. The predetermined distance properly positions the tubing hanger 42 at a prescribed elevation relative to the wellhead 16. For example, the predetermined distance may locate the upper end of the tubing hanger 42 within an inch or two above or below the top of the wellhead 16 and the tubing hanger lower tubular member 52 and the sealing and lockdown assembly 54 are vertically held in position in the casing 24.

Referring to FIG. 4B, after landing the tubing hanger 42, a well completion fluid is circulated in the well 10 by pumping the completion fluid from a surface supply through lines in the BOP stack 60 and into the tubing hanger running tool annulus access bore 30*b*, the tubing hanger annulus passageway 42*b*, the lower member production annulus and the production tubing annulus 44*b*. The completion fluid then returns to the surface up through the production tubing bore 44*a*, tubing hanger production bore 42*a*, running tool production bore 30*a* and the installation tubing string 50. The completion fluid is circulated in the well 10 prior to the lower packer 46 being set to form a seal between the casing 24 and the production tubing 44 at the lower end of the well 10. This circulation of completion fluid can be conducted either prior to or after setting the sealing apparatus 56.

The sealing and lockdown assembly 54 is activated using the hydraulic control lines 55 to force the lockdown apparatus 58 into tight locked engagement with the casing 24. The engaged lockdown apparatus 58 prevents relative vertical movement between the lower assembly 52 and the casing 24. Upon activation, the sealing apparatus 56 forms a fluid- or gas-tight seal between the lower assembly 52 and the casing 24.

As will be described below, this sealing, locking and suspension of the tubing hanger assembly 40 is accomplished and installed without any specific angular orientation between or among the wellhead 16, the BOP stack 60, the tubing hanger 42, and the tubing hanger running tool 30.

After setting and testing the sealing and lockdown assembly 54 and the lower packer 46, and with the SSSV 48 and the annulus isolation valve 49 closed, a removable plug (not shown) is installed in the production tubing bore 44*a*, and the tubing hanger running tool 30 is disconnected from the tubing hanger 42 and retrieved to the surface. The BOP stack 60 then is removed from the wellhead 16.

Figure 5:
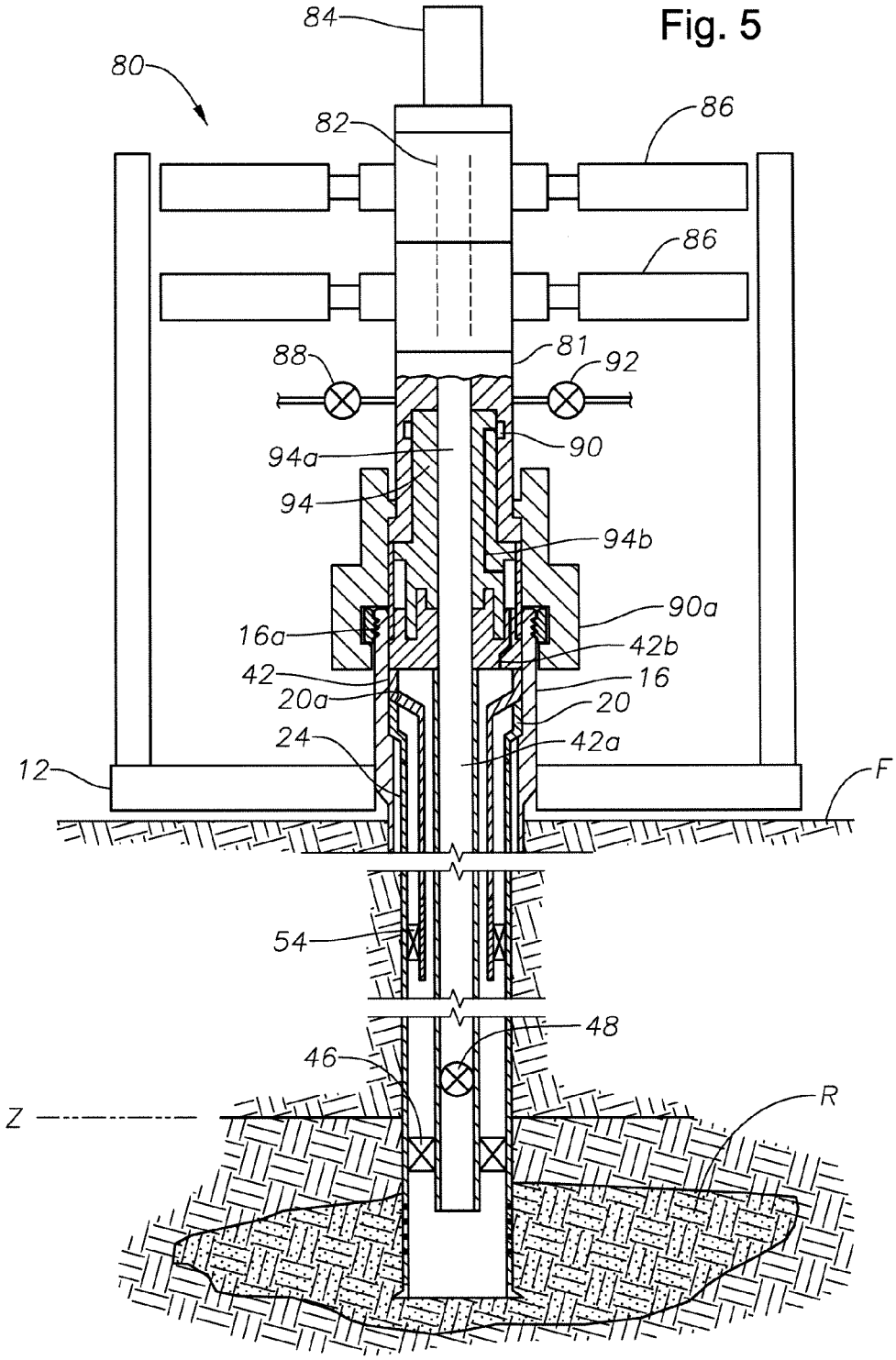
FIG. 5 illustrates the subsea well of FIG. 1 with a Christmas tree installed.

Next, a Christmas tree assembly 80, an example of which is shown in FIG. 5, is lowered from the water surface and installed on the wellhead 16. The Christmas tree assembly 80 has a production bore 82, production master valve 84, production wing valves 86 and a production swab valve 88. The Christmas tree assembly 80 also includes an annulus bore 90 and an annulus master valve 92. The Christmas tree assembly 80 has a tree wellhead connector 90*a* to seal and connect with the wellhead 16.

FIG. 5 shows the Christmas tree assembly 80 with a tree-to-tubing hanger stab sub assembly 94 coupled at its upper end to housing 81 and providing various interconnections between the Christmas tree assembly 80 and the tubing hanger 42. The stab sub assembly 94 may be installed in the Christmas tree assembly 80 before lowering the Christmas tree assembly 80 to the wellhead 16. The stab sub assembly 94 includes a production bore 94*a* in sealed engagement with the Christmas tree production bore 82 and forming a sealed engagement with the tubing hanger production bore 42*a* upon the installation of the Christmas tree assembly 80 on the wellhead 16. Similarly, the stab sub assembly 94 also includes an annulus bore 94*b* in sealed engagement with the Christmas tree annulus bore 90. The annulus bore 94*b* forms a sealed engagement with the tubing hanger annulus bore 42*b* upon the installation of the Christmas tree assembly 80. One or more hydraulic control lines (not shown in FIG. 5) in the stab sub assembly 94 provide connection to hydraulic lines for the control of downhole equipment and devices. Additionally, other ports or lines, such as a chemical injection line, may be provided in the stab sub assembly 94. As used herein, the term "lines" in reference to the hydraulics and chemical injection is meant to include either tubing, conduit, bores, channels or ports in solid members, as for example the tubing hanger 42 or stab sub assembly 94.

The production bore 94*a*, annulus bore 94*b*, and various other bores of the stab sub assembly 94 provide, as will be described with respect to FIGS. 6A-14, fluid communication and electrical signaling from above the surface, through the Christmas tree assembly 80 and stab sub assembly 94 to various downhole components such as the seal and lockdown assembly 54 and the SSSV 48, for example. Because of this arrangement of bores in the stab sub assembly 94, and corresponding circumferential channels and/or bores in the tubing hanger 42, there is no need to provide any angular alignment or orientation between the Christmas tree assembly 80 and the tubing hanger 42. This same system of ports, lines, bores, and circumferential channels that is used to eliminate any need for angular orientation between the Christmas tree assembly 80 and the tubing hanger 42 may be applied to the BOP stack 60 and the tubing hanger running tool 30, or any other component used for installing and completing the well 10. However, the discussion that follows will refer to the alignment-free assemblage of the Christmas tree assembly 80 and the tubing hanger 42.

Figure 6A:
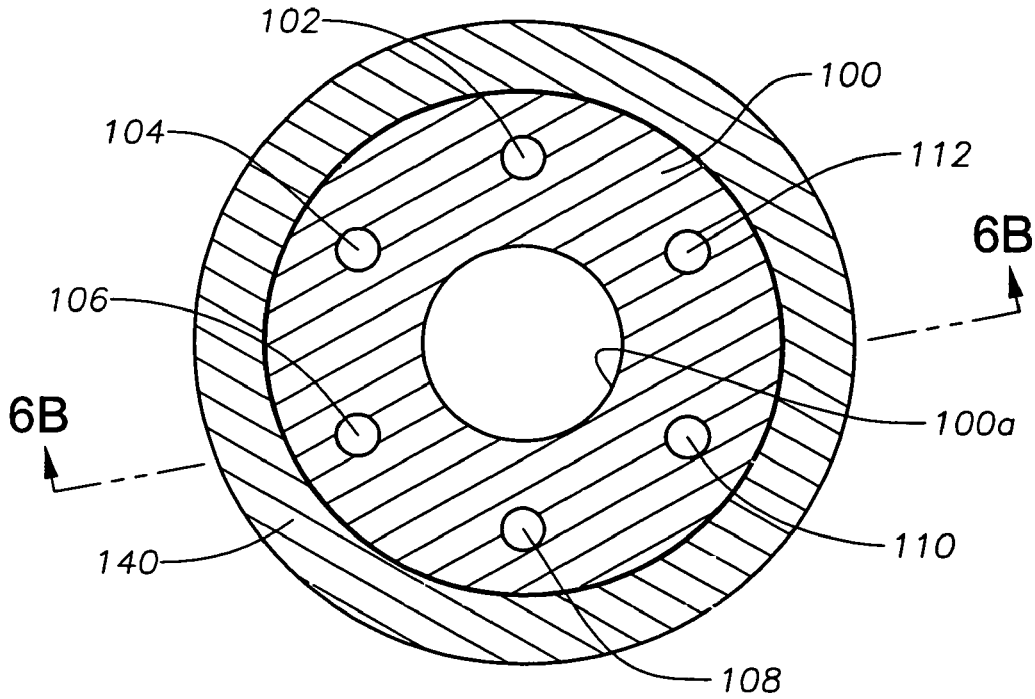
FIGS. 6A-8C are simplified schematic views of embodiments of angular alignment-free connection configurations for a subsea oil or gas well.

FIGS. 6A-8C are simplified schematic views of embodiments of angular alignment-free connection configurations for a subsea oil or gas well. FIG. 6A illustrates a horizontal slice of stab sub assembly 100 that may be landed in the wellhead 16 of well 10 (FIG. 1) as part of Christmas tree assembly 80. As shown, the stab sub assembly 100 includes production bore 1000*a* that would be in communication with bore 42*a* of tubing hanger 42. The stab sub assembly 100 includes a number of bores to provide hydraulic or electrical services to downhole components of the well 10. Each such bore may be dedicated to a specific service. Alternately, two or more bores may be combined to provide a single service. In an example, bores 102 and 108 provide for lock and unlock services, bore 104 is a SSSV bore, bore 106 provides for chemical injection, bore 110 is an annulus bore, and bore 112 provides electrical services. Each of the bores penetrates the stab sub assembly 100 to a specific depth, and the depth of penetration differs among bores of different services.

Figure 6B:
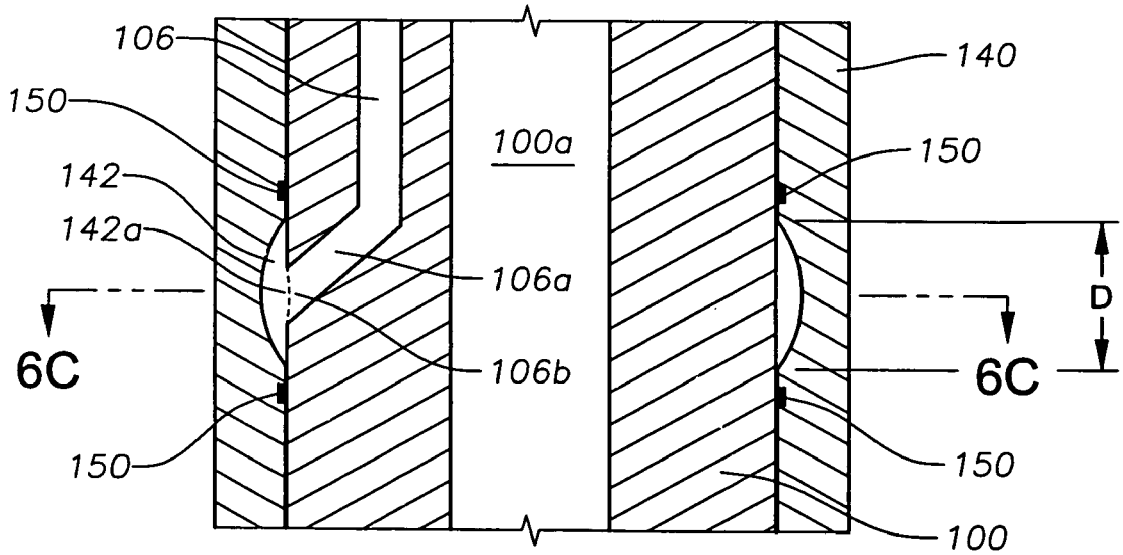

FIG. 6B illustrates a cross-section lateral view of the stab sub assembly 100 and its mated tubing hanger 140 of FIG. 6A. As shown in FIG. 6B, the stab sub assembly 100 is landed in the tubing hanger 140. Bore 106 (chemical injection) penetrates vertically the stab sub assembly 100 and terminates in take-off 106*a*. Take-off 106*a* mates with circumferential channel 142, which is milled completely around the inner periphery of the tubing hanger 140. Precise vertical alignment of the take-off 106*a* and the circumferential channel 142 is obviated by sizing terminus 106*b* of the take-off 106*a* to have a smaller vertical dimension than corresponding opening 142*a* of the circumferential channel 142. Alternatively, the terminus 106*b* could have a larger vertical dimension than the opening 142*a*. With either arrangement, the vertical alignment of the stab sub assembly 100 and tubing hanger 140 can vary (dimension D) so long as the terminus 106*b* and opening 142*a* are capable of communication. To prevent possible leakage of fluids along the boundary between the stab stub 100 and the tubing hanger 140, one or more two-way or bi-directional seals 150 may be provided above and below the circumferential channel 142.

Figure 6C:
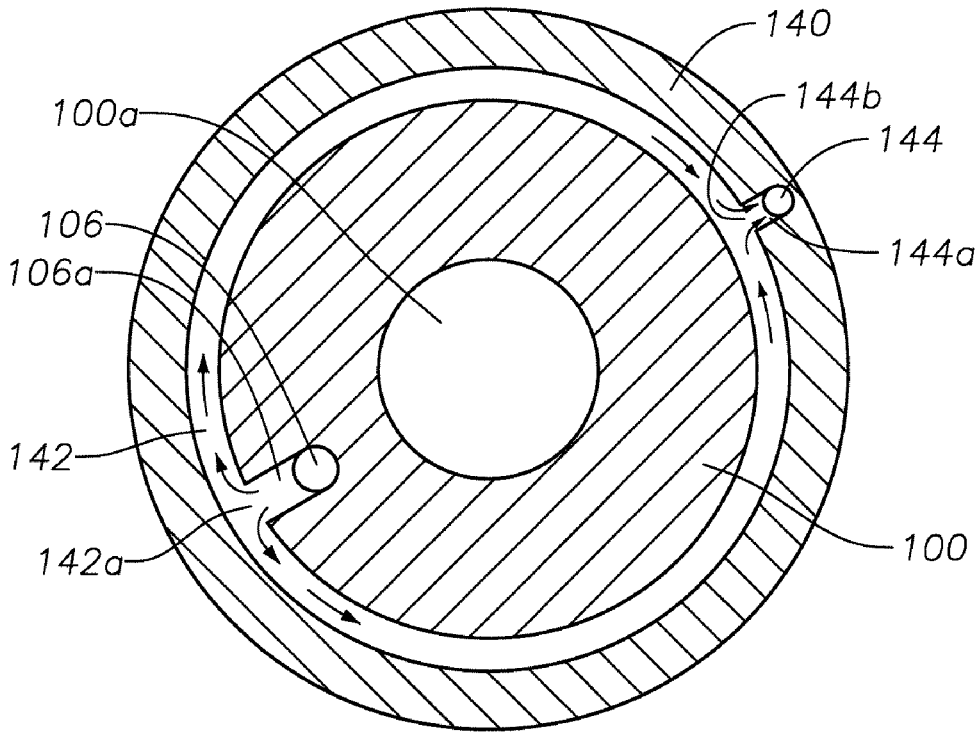

FIG. 6C is a cross-section lateral view of the stab sub assembly 100 and tubing hanger 140 of FIG. 6B showing the arrangement of bores and circumferential channels. As shown, circumferential channel 142 extends around the inner surface of the tubing hanger 140 and abuts the outer surface of the stab sub assembly 100. Bore 106 communicates with the circumferential channel 142 by way of take-off 106*a*, terminus 106*b*, and opening 142*a*. To provide fluid communication from the circumferential channel 142 to downhole components (in this example, the chemical injection service) a bore 144 is provided in the tubing hanger 140. Bore 144 connects to the circumferential channel 142 through opening 144*b* and takeoff 144*a*.

Figure 7:
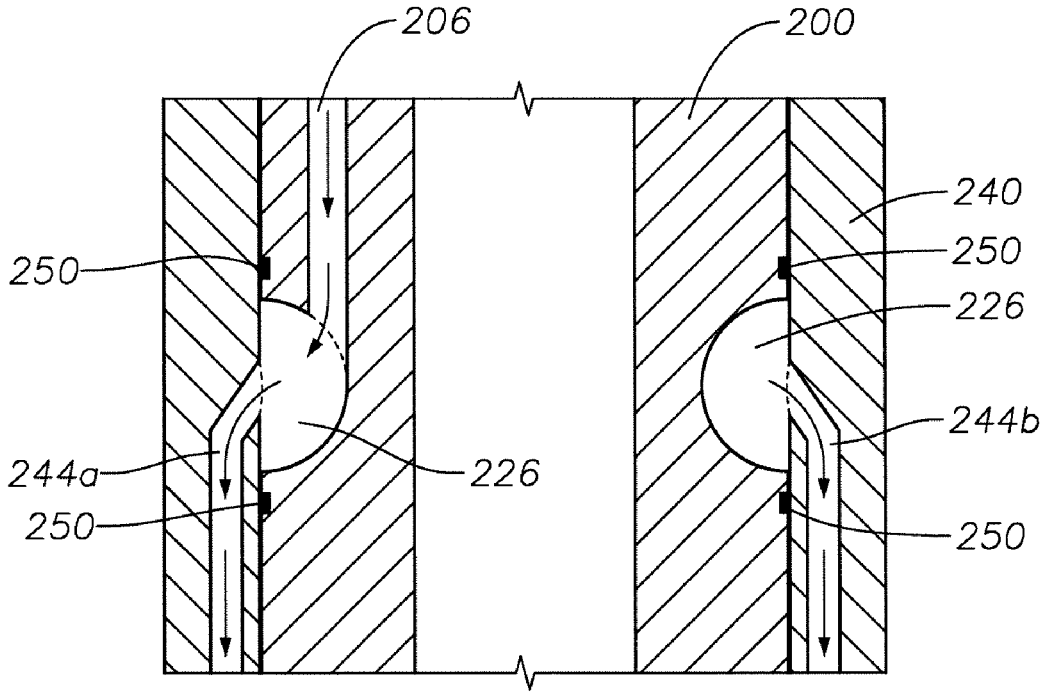

In an alternative embodiment, instead of circumferential channels formed on the tubing hanger, the circumferential channels are formed on the stab sub assembly. FIG. 7 is a vertical cross section of tubing hanger 240 and stab sub assembly 200 showing such an arrangement. In FIG. 7, circumferential channel 226 is formed around the outer periphery of stab sub assembly 200. Circumferential channel 226 is in communication with bore 206, which vertically penetrates the stab sub assembly 200. To provide fluid communication downhole, bores 244*a* and 244*b* connect to the circumferential channel 226. Bi-directional seals 250 between the stab sub assembly 200 and tubing hanger 240 control any fluid leakage into or out of the circumferential channel 226. Although FIG. 7 shows the bores 244*a* and 244*b* in the same vertical cross section as the bore 206, the bores 244*a*, 244*b*, and 206 may be arranged at different radial positions. Furthermore, the connections shown in FIG. 7 are not limited to two bores 244*a* and 244*b* in the tubing hanger 240 and one bore 206 in the stab sub assembly 200. More or fewer bores may be provided as needed to provide a sufficient cross-sectional flow area for the intended service.

Figure 8A:
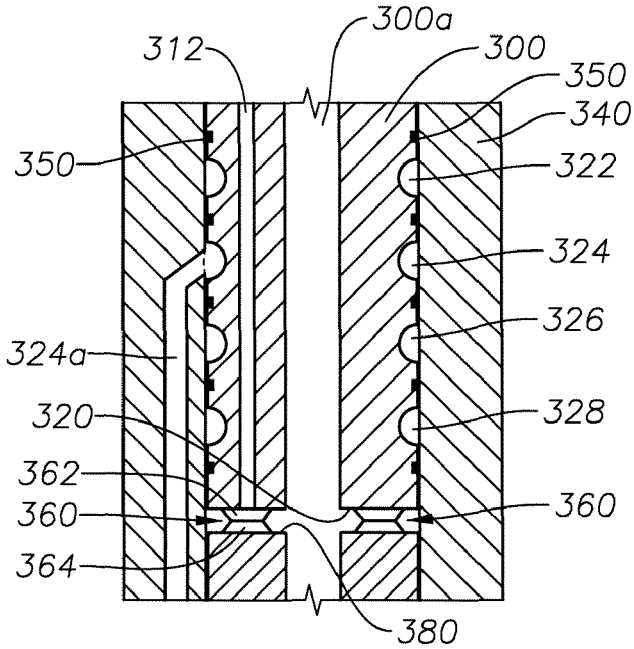

FIG. 8A further illustrates the connection arrangement of FIG. 7, wherein circumferential channels are formed on the stab sub assembly. As shown in FIG. 8A, four circumferential channels 322, 324, 326, and 328 are formed in stab sub assembly 300, with each channel completely encircling the stab sub assembly 300 at a specific vertical distance from the top of the stab sub assembly 300. Bi-directional seals 350 control fluid leakage into or out of the circumferential channels. Communicating downhole through the tubing hanger 340 are bore(s) 344*a* which connect to circumferential channel 324.

Although FIG. 8A shows the circumferential channels as equally spaced vertically, and of the same cross-sectional area, the channels are not so restricted. Instead, the circumferential channels may be spaced at any vertical position on the boundary between the tubing hanger and the well completion device (e.g., the stab sub assembly), and may vary in size according to the desired service. In addition, not all channels need be formed in the tubing hanger of the well completion device, exclusively. In some well configurations, a specific number of the circumferential channels may be formed on the tubing hanger and the remaining channels formed on the well completion device.

Also shown in FIG. 8A is electrical service bore 312, which terminates in make-break electrical connector 360. Because it is used in an underwater application, the make-break electrical connector 360 must be designed so that all the moisture is removed from between the contacts upon assembly and prevented from entering the connection after assembly. To achieve this underwater dependability, electrical connector 360 includes an upper connection element 362 and a lower connection element 364 such that when the two elements are engaged, moisture is precluded from the connector 360. The electrical connector 360 is shown formed at a bottom surface 320 of the stab sub assembly 300 where the stab sub assembly 300 contacts shoulder 380 of the tubing hanger 340. In an embodiment, the upper and lower connection elements 362, 364 form complete circumferential connections around bore 300*a*.

One example of a make-break electrical connection that can be used underwater or in other environments where moisture can be an issue is formed by using one or more conductive elastomeric conductor elements or contacts. One conductive material that can be used for the contacts is a conductive silicone rubber material sold by the Chomerics Division of the Parker Hannifin Corp., Woburn, Mass. This material is formed of a silicone rubber that has clean, high structure, conductive particles such as silver powder dispersed throughout. High structure refers to irregularly-shaped, sharp-cornered particles, which can be contrasted with relatively smooth and round particles that are referred to as having low structure. Particles formed of other types of conductive materials, such as copper or gold, could also be used. When the material is compressed, the particles move into closer contact with each other and form an enhanced electrically-conductive path within the contact material.

An effective underwater, make-break electrical connection can be made by forming one or both of the contacts of such a conductive elastomer material. These contacts are shaped so that when they contact each other, at least one of them is compressed for enhancing the conductivity of the conductive particles inside the contact. When the material is deformed, the conductive particles dispersed throughout the material will move into closer contact with each other and form an enhanced electrically-conductive path in the contact for transmitting electric current from an electric wire in the contact to the other contact. An advantage of using a conductive elastomer as a contact is that neither element in an electrical connection has to be shaped in the form of a receptacle that receives the other one, which eliminates the need to remove moisture from the receptacle. Another advantage of this type of connection is that it does not have any traps or seals that might cause a pressure imbalance when the seal is not made up, so all the exposed parts will have the same relative pressure at all times.

An insulating layer in the form of a protective coating such as silicone grease may be coated on the outer surface of the contact to isolate and prevent oxidation of portions of the conductive particles that are exposed to the atmosphere or water. When one or more of the contacts are compressed sharp edges of the conductive particles penetrate the silicone grease to complete the electrical connection by contacting the other contact.

Figure 8B:
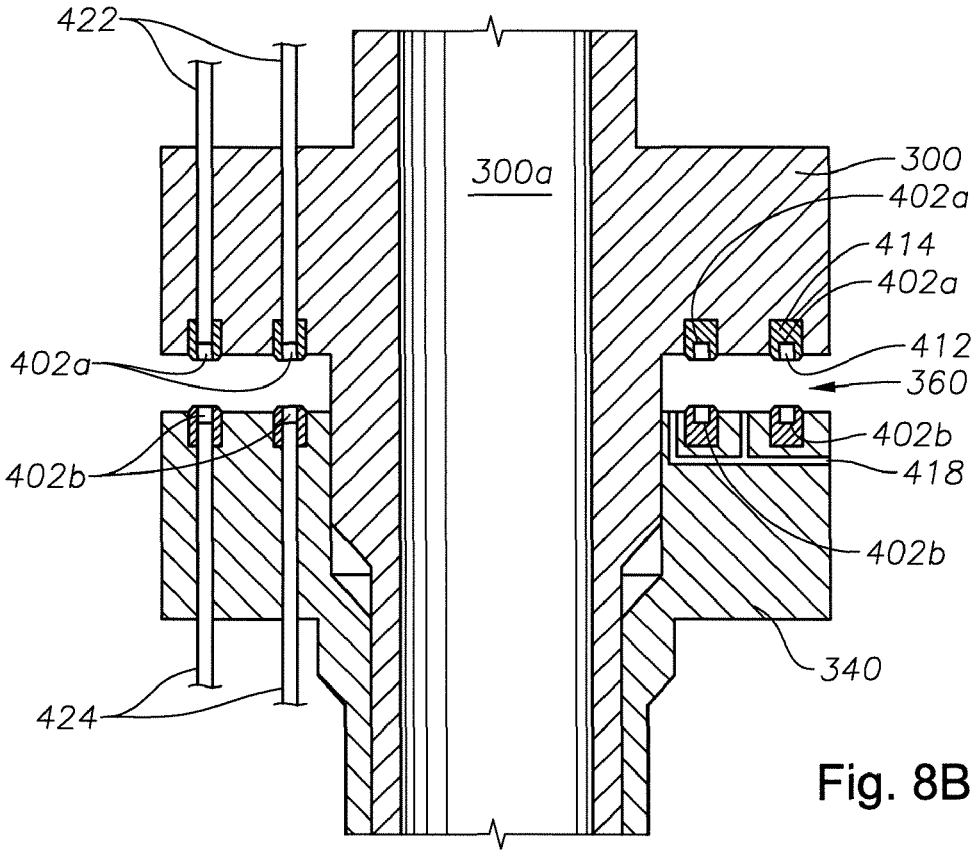

FIG. 8B illustrates the electrical connector 360 in more detail. As shown, the connector 360 uses multiple, concentric, ring-shaped contacts 402*a* and 402*b* formed of a conductive elastomer that are positioned in a groove 412 in insulated housing 414. Conduit 418 is provided between the concentric contacts so that, upon assembly of the connector 360, any fluid between pairs of contacts can escape when the electrical connections are made up. The connector 360 is connected to an electrical supply (or supplies) though leads 422 and is connected downhole electrical components through leads 424.

As shown in FIGS. 8A and 8B, as the tubing hanger 340 engages the stab sub assembly 300, the ring-shaped concentric contacts 402*a* and 402*b* begin to engage each other. The connectors 402*a* and 402*b* compress and complete an electrical connection between the electrical leads 422 and 424. In addition, as the contacts 402*a* and 402*b* compress, any water or other fluid between them will be squeezed out.

As noted above and as shown in FIGS. 8A and 8B, the contacts 402*a* and 402*b* are ring-shaped and extend around the periphery of the well bore 300*a*. In this way the connection 360 is non-orienting, which means that the contacts 402*a* and 402*b* do not have to have any particular radial orientation in order to complete the electrical connections.

Figure 8C:
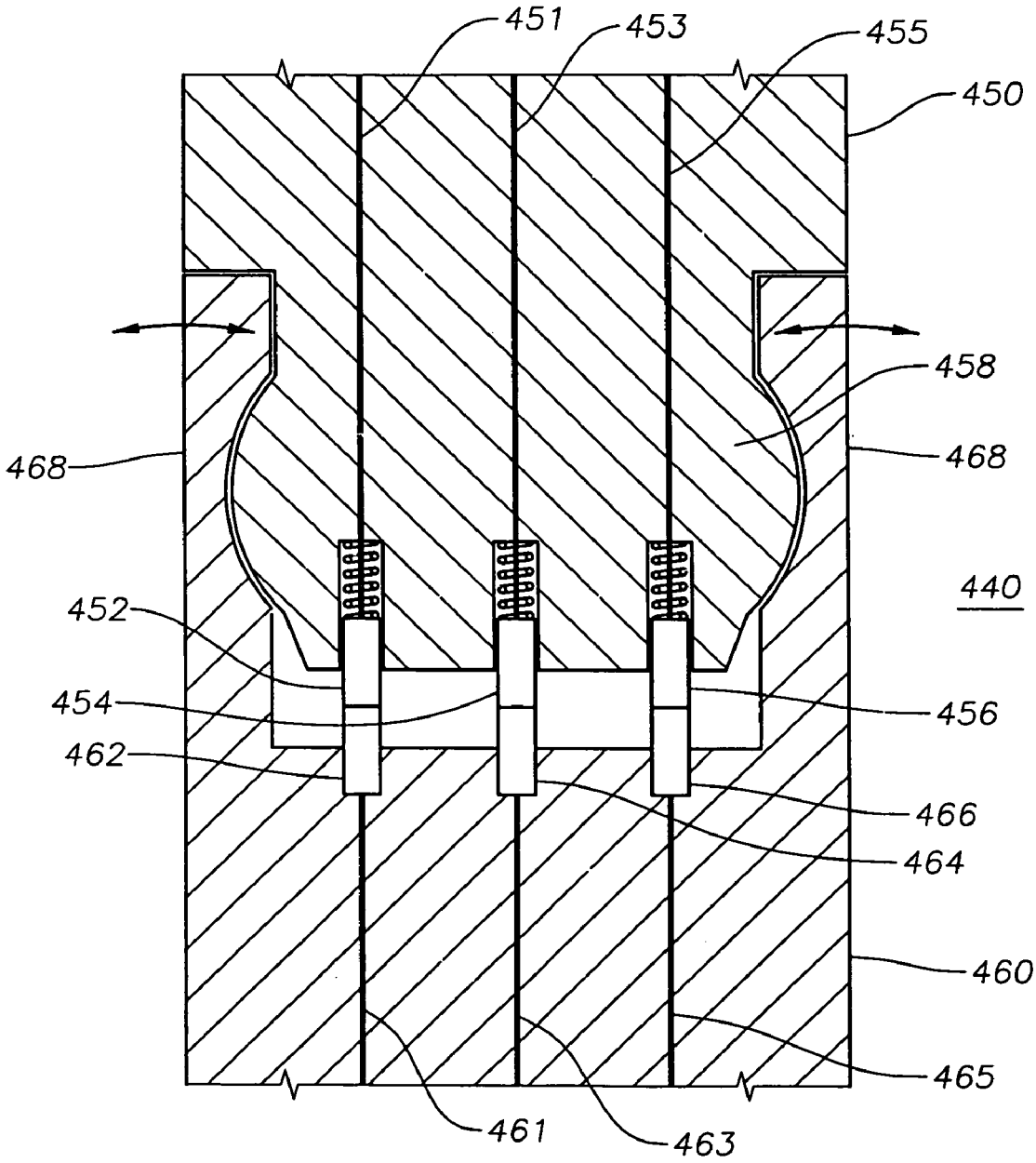

Another example of a dependable make-break connection involves the use of mechanical elements to remove moisture from the contact area and to prevent subsequent re-introduction of moisture into the contact area. Such a make-break electrical connector 440 is shown in FIG. 8C. As with the connector 360 of FIG. 8A, the connector 440 uses one or more pairs of non-orienting, ring-shaped contacts, and associated mechanical devices and profiles.

As shown in FIG. 8C, electrical connector 440 includes top connector 450, which may be mated to the well completion device, and bottom connector 460, which may be mated to the tubing hanger. The top connector 450 is shown with three leads 451, 453, 455 that connect to spring-mounted contacts 452, 454, 456. The top connector 450 includes engagement section 458 which is designed to lock the top connector 450 to the bottom connector 460.

The bottom connector 460 is shown with three leads (461, 463, 465) and contacts (462, 464, 466) corresponding to the contacts and leads of the top connector 450. The bottom connector 460 includes engagement wings 468 that initially move apart upon landing the well completion device in the tubing hanger, and then return to their original position when the engagement is complete. The connector 440 may be filled with an insulating compound so that no moisture is trapped within the connector 440 during the engagement process. The connector 440 also may be provided with a drain tube or conduit to allow any water or moisture to be forced out of the engagement area of the connector 440.

Returning to FIG. 5, after the Christmas tree assembly 80 secured and tested, the closure plug is retrieved to the surface through the bores of the production tubing 44, tubing hanger 42, stab sub assembly 94, Christmas tree assembly 80, tree running tool and the installation tubing string. Installation and removal of these components is greatly facilitated by the herein described design of the angular alignment-free mechanical, electrical, and hydraulic connections used to complete the completed well 10. FIGS. 9-14 provide more specific elements and aspects of the alignment-free design features.

Figure 9:
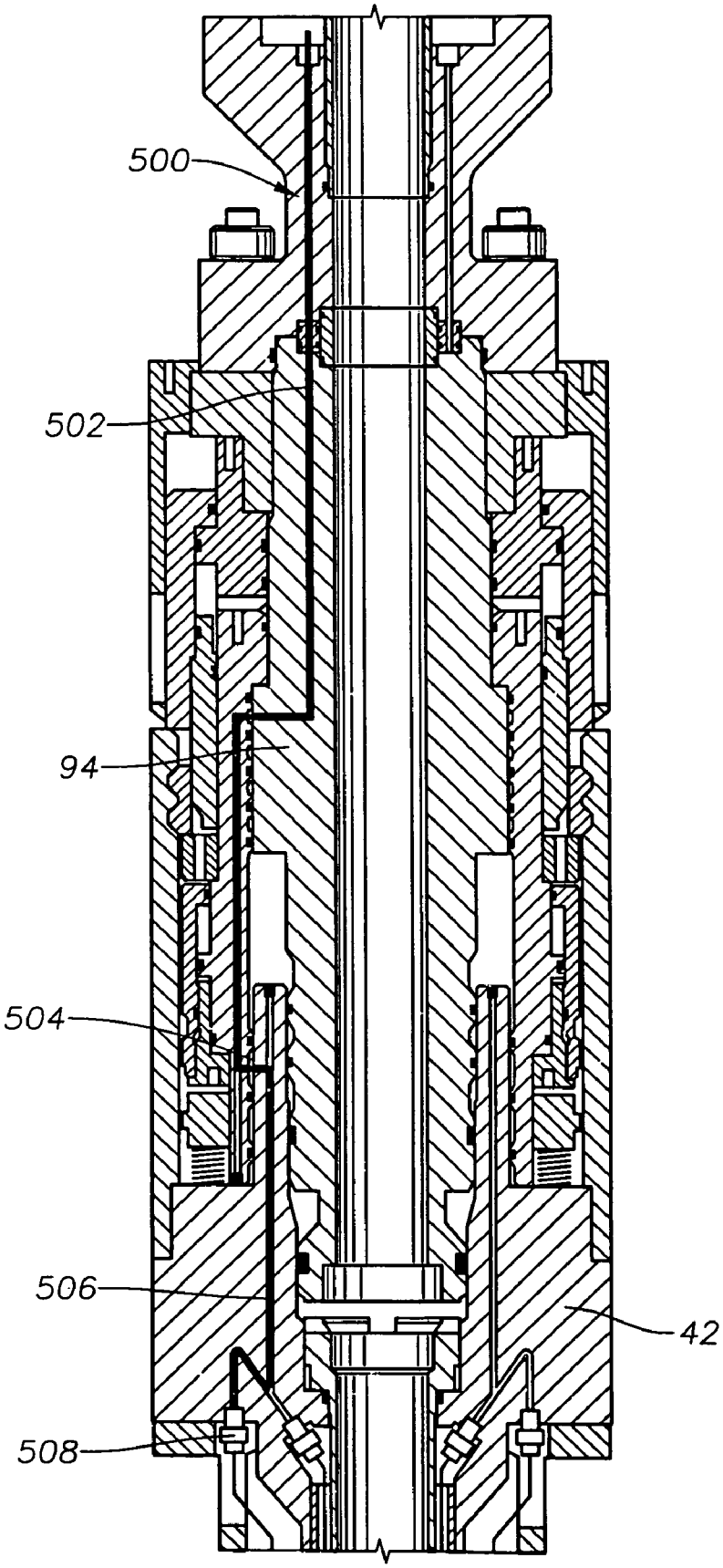
FIGS. 9-14 are cutaway sectional views of a completed subsea well illustrating relationships between various channels and bores for communicating fluids and electricity between the wellhead and downhole components using the angular alignment-free connection configurations shown in FIGS. 6A-8C.
Figure 10:
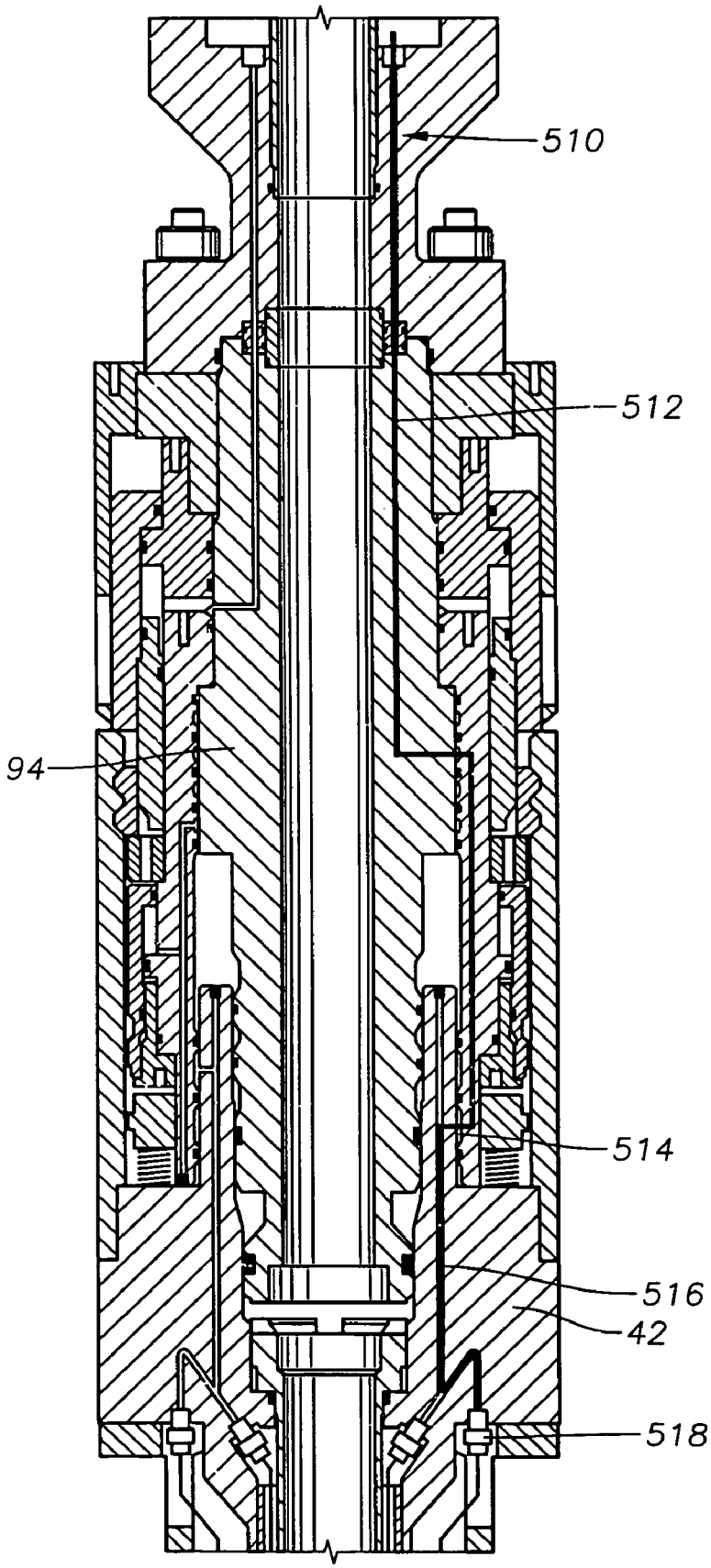

FIGS. 9 and 10 are cutaway vertical sectional views of the stab stub assembly 94 landed in the well 10 and engaging the tubing hanger 42. In FIG. 9, unlock circuit 500 is shown including outlet bore 502 for fluid communication with a top side (surface) hydraulic repository. The outlet bore 502 traverses the stab sub assembly 94 until reaching circumferential channel 504 formed at the boundary between the stab sub assembly 94 and the tubing hanger 42. Corresponding tubing hanger bore 506 is in fluid communication with the circumferential channel 504, and provides a path for hydraulic fluid to unlock the locking mechanism 58 (see FIGS. 4B and 4C). Finally, the unlock circuit may include isolation valve 508. FIG. 10 shows corresponding lock circuit 510, including inlet bore 512, circumferential channel 514, tubing hanger bore 516 and isolation valve 518.

Figure 11:
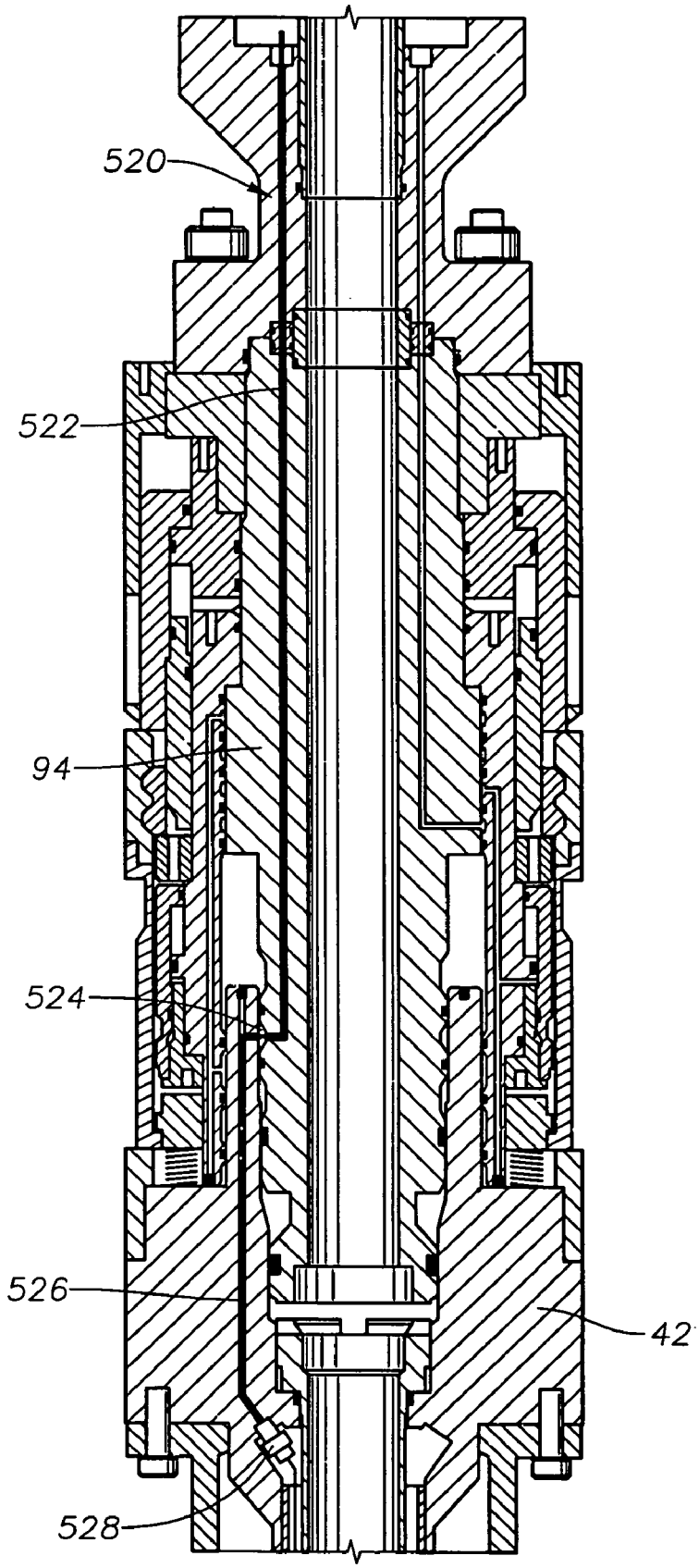

FIG. 11 is a cutaway vertical view showing downhole chemical injection circuit 520. Circuit 520 includes inlet bore 522 to receive chemicals for injection downhole, circumferential channel 524 to provide a non-aligning fluid path to tubing hanger bore 526, and isolation valve 528.

Figure 12:
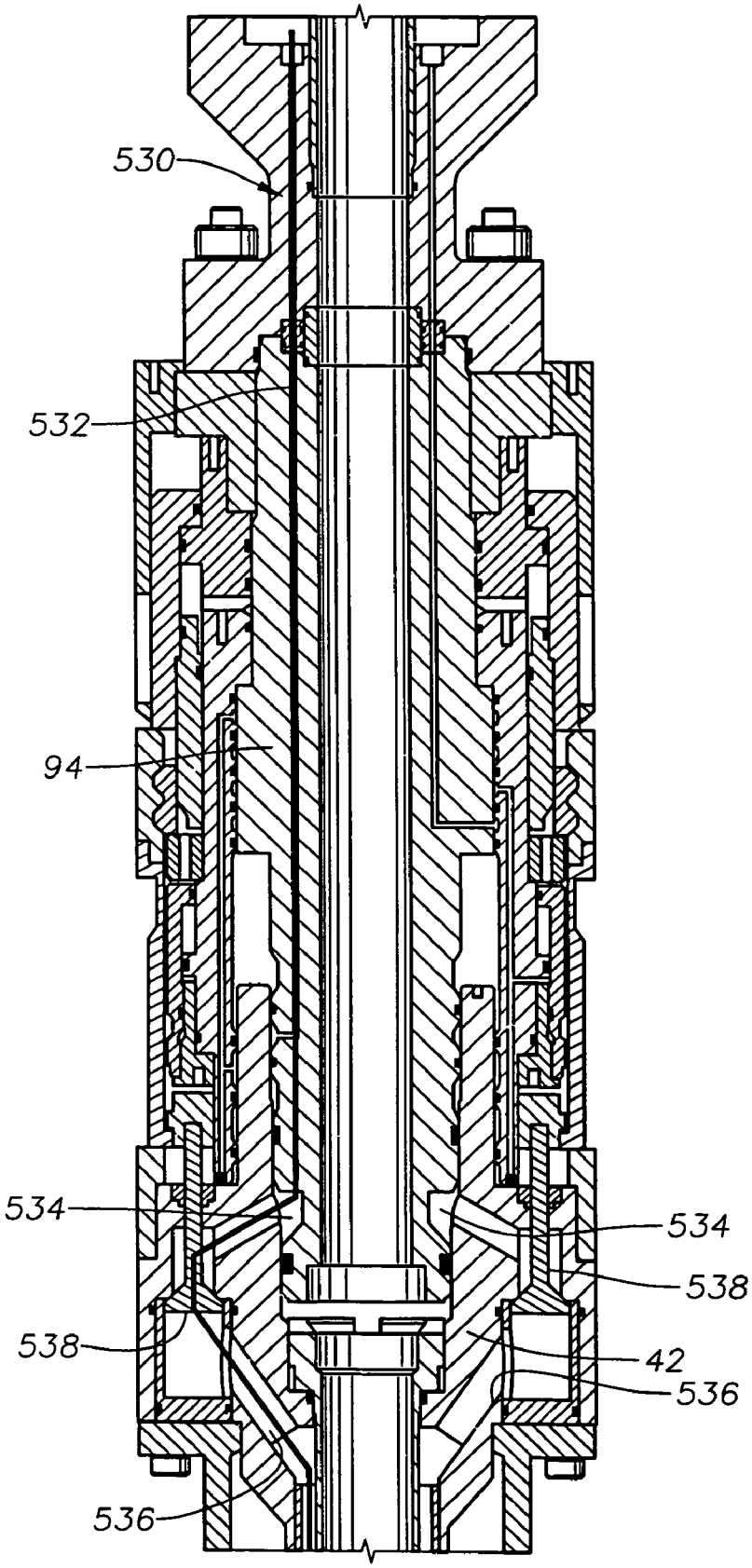

FIG. 12 is a cutaway vertical view showing annulus circuit 530. Annulus circuit 530 includes inlet bore 532, circumferential channel 534, isolation valves 538, and tubing hanger bores 536.

Figure 13:
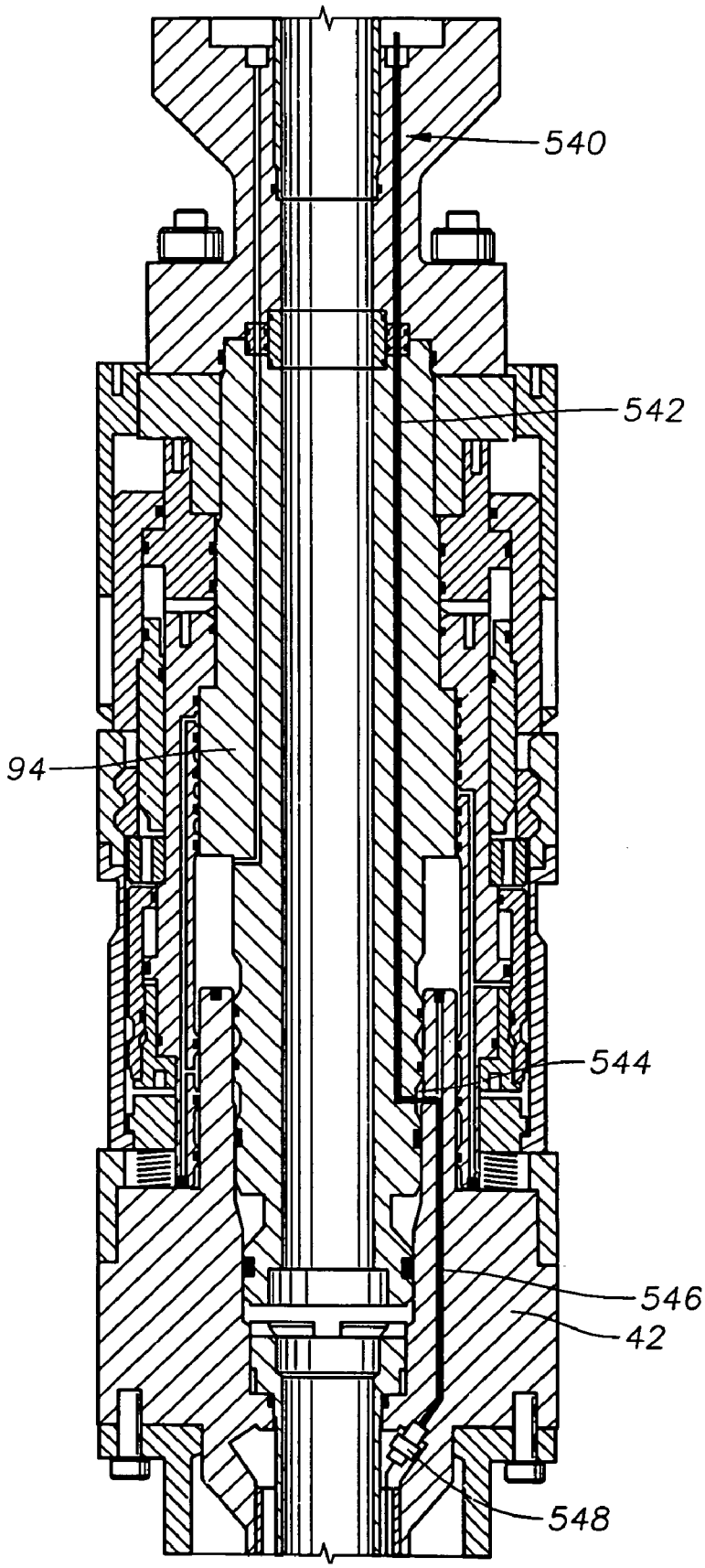

FIG. 13 is a cutaway vertical view showing subsea safety valve (SSSV) circuit 540. SSSV circuit 540 includes outlet bore 542, circumferential channel 544, isolation valve 548, and tubing hanger bore 546.

Figure 14:
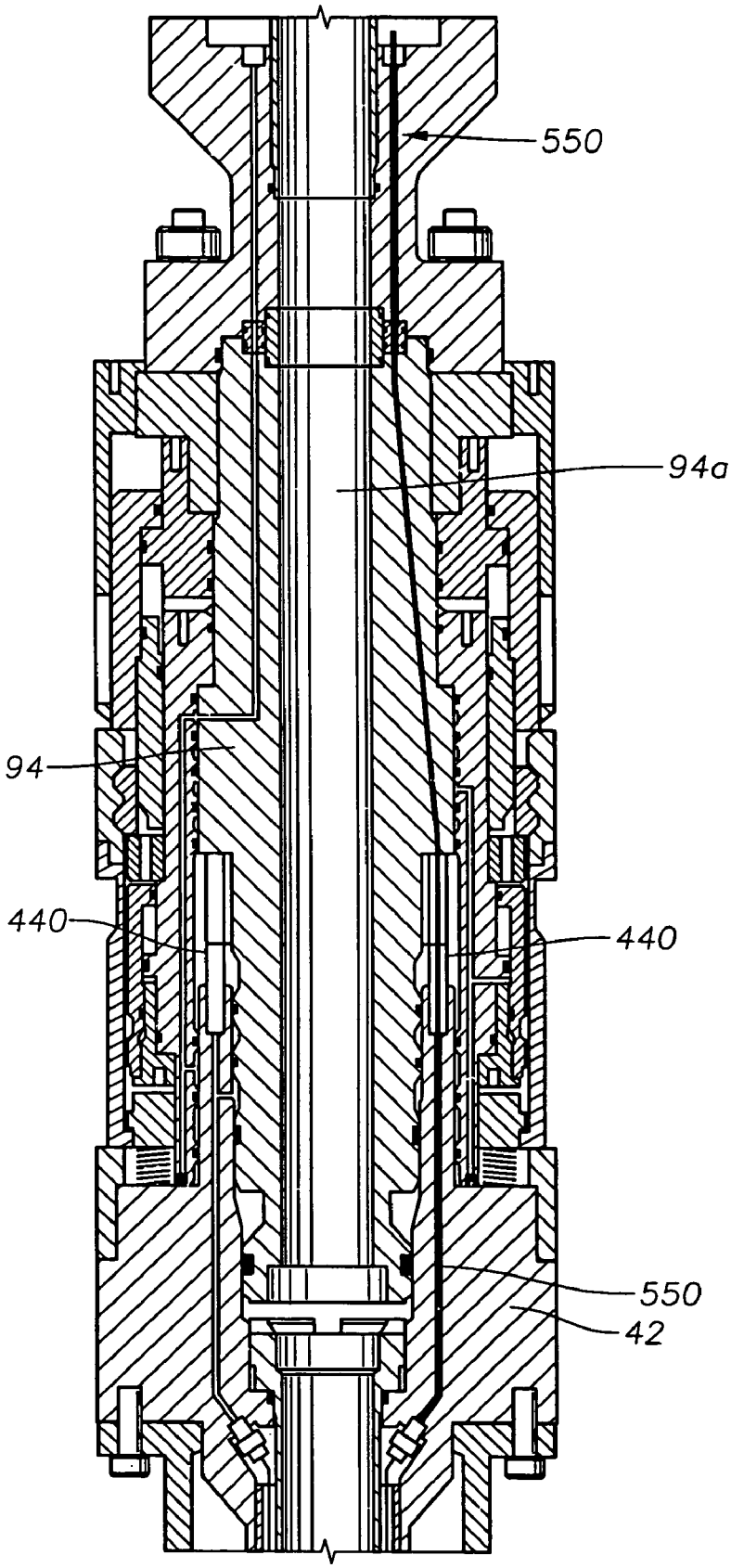

FIG. 14 is a cutaway vertical view of the stab stub assembly 94 landed in the well 10 and engaging the tubing hanger 42 and showing electrical circuit 550, including alignment-free make-break electrical connector 440.

In the above-description, exemplary well completions systems that require no specific angular alignment have been described and illustrated. However, the inventions recited in the claims that follow are not limited to these described embodiments. Various modifications and alternations to the inventions will be apparent to those skilled in the art, without departing from the true scope of the claims.

The invention claimed is:

1. A completion system for a subsea well (10), which includes a wellhead (16) and a tubing hanger (42) that is disposed in the wellhead and supports a string of production tubing (44), the completion system comprising:

a plurality of circumferential channels (322, 324, 326, 328) formed at a boundary between the tubing hanger (42) and a well completion device, the circumferential channels providing complete circular fluid paths with respect to the tubing hanger (42) and the well completion device;

at least one supply bore (206) in communication with each channel and oriented to supply a fluid to the channel;

at least one drain bore (244*a*) in communication with each channel and oriented to remove fluid from the channel; and a circumferential electrical connector (440) coupling the tubing hanger (42) and the completion device, wherein the circumferential channels and bores provide fluid services between the completion device and the tubing hanger and the electrical connector provides electrical services to the tubing hanger, the fluid and electrical services are provided without requiring any angular alignment between the tubing hanger and the completion device, and wherein the fluid services being selected from the group consisting of a subsea safety valve service (540), lock/unlock services (500/510), a chemical injection service (520), and an annulus service (530).

2. The completion system of claim 1, wherein the completion device is a Christmas tree (80), and wherein the Christmas tree includes a stab sub assembly (94) that connects the Christmas tree (80) and the tubing hanger (42) to supply the fluid and electrical services.

3. The completion system of claim 1, wherein the completion device is a blowout preventer stack (60).

4. The completion system of claim 1, wherein the completion device is a tubing hanger running tool (30).

5. The completion system of claim 1, wherein the plurality of circumferential channels is formed in the tubing hanger (42).

6. The completion system of claim 1, wherein the plurality of circumferential channels is formed in the completion device.

7. The completion system of claim 1, wherein at least one of the circumferential channels is formed in the tubing hanger (42) and the remaining circumferential channels are formed in the completion device.

8. The completion system of claim 1, wherein the lock/unlock service (500/510) provides hydraulic fluid to lock and seal a tubing hanger lower assembly (52) to well casing (24) in the well (10).

9. The completion system of claim 1, wherein the annulus service (530) provides annulus access from the completion device to the production tubing annulus (52*a*).

10. The completion system of claim 1, wherein the circumferential channels are semi-circular in cross-section.

11. The completion system of claim 1, wherein the circumferential channels are rectangular in cross-section.

12. A well completion system, comprising:

a wellhead (16) positioned at a seabed;

a well casing string (24) received in the wellhead (16) and extending down a well bore (B);

a tubing hanger (42) received in the wellhead and connected to a string of production tubing (44) extending into the well bore, wherein the tubing hanger comprises a plurality of lower bores for communicating services to downhole components of the well (10);

a well completion device mated to the wellhead, the well completion device having a lower element extending into the tubing hanger (42), wherein the well completion device comprises a plurality of upper bores for communicating services to the lower bores; and a plurality of circumferential channels (322, 324, 326, 328) formed at an interface between the tubing hanger (42) and the well completion device, each circumferential channel coupling one or more upper bores with one or more lower bores, and wherein the well completion device is mated to the wellhead without any requirement for angular alignment with the tubing hanger (42), wherein the services being selected from the group consisting of a subsea safety valve service (540), lock/unlock services (500/510), a chemical injection service (520), and an annulus service (530).

13. The completion system of claim 12, wherein the circumferential channels are formed in the tubing hanger.

14. The completion system of claim 12, wherein the circumferential channels are formed in the completion device.

15. The completion system of claim 12, where a number of the circumferential channels are formed in the tubing hanger and the remaining circumferential channels are formed in the completion device.

16. The completion system of claim 12, wherein the lock/unlock service (500/510) provides hydraulic fluid to lock and seal a tubing hanger lower assembly (52) to well casing (24) in the well (10).

17. The completion system of claim 12, wherein the annulus service (530) provides annulus access from the completion device to the production tubing annulus (52*a*).

18. The completion system of claim 12, wherein the circumferential channels are semi-circular in cross-section.

19. The completion system of claim 12, wherein the circumferential channels are rectangular in cross-section.

20. The completion system of claim 12, wherein the completion device is a Christmas tree (80), the Christmas tree including a stab sub assembly (94) that connects the Christmas tree (80) and the tubing hanger (42) to supply the fluid and electrical services.

21. The completion system of claim 12, wherein the completion device is a blowout preventer stack (60).

22. The completion system of claim 12, wherein the completion device is a tubing hanger running tool (30).

23. The completion system of claim 12, further comprising one or more seals (150) positioned above and below each of the circumferential channels, the seals preventing fluid communication along the boundary between the completion device and the tubing hanger.

24. In a completion system for a subsea well having a wellhead (16) positioned at a seabed and a casing hanger (20) connected to the wellhead with a string of casing (24) depending from the casing hanger and extending down a well bore (B), the improvement comprising:

a tubing hanger assembly (40) including a tubing hanger (42) received in the wellhead and a string of production tubing (44) extending down the well bore (B), the tubing hanger having an upper end, a lower end, a production bore (42*a*), an annulus bore (42*b*) and a service port;

a well completion device mated to the tubing hanger (42), the well completion device including a production bore (94*a*), an annulus bore (94*b*) and a service port, the well completion device production bore (94*a*) in sealing engagement with the tubing hanger production bore;

a first and second circumferential channel (322, 324, 326, 328) formed at a boundary between the tubing hanger (42) and the well completion device, the first and second circumferential channels providing complete circular fluid paths with respect to the tubing hanger (42) and the well completion device, the first circumferential channel in communication with the tubing hanger annulus bore and the well completion device annulus bore and the second circumferential channel in communication with the tubing hanger service port and the well completion device service port;

wherein the circumferential channels provide fluid services between the completion device and the tubing hanger without any requirement for angular alignment between the tubing hanger and completion device.

25. The completion system of claim 24, wherein the completion device is a Christmas tree (80) that mates to the wellhead, the Christmas tree including a stab sub assembly (94) that connects the Christmas tree (80) and the tubing hanger (42) to supply the fluid services.

26. The completion system of claim 24, wherein the service port provides hydraulic or chemical services to components down in the well.

27. The completion system of claim 24, further comprising a circumferential electrical connector coupling the tubing hanger and the completion device for providing electrical services to the tubing hanger.

* * * * *